US010286723B1

(12) United States Patent
De Salvo

(10) Patent No.: US 10,286,723 B1
(45) Date of Patent: May 14, 2019

(54) WRITING IMPLEMENT ASSEMBLY

(71) Applicant: Isaac De Salvo, Clearwater, FL (US)

(72) Inventor: Isaac De Salvo, Clearwater, FL (US)

( * ) Notice: Subject to any disclaimer, the term of this patent is extended or adjusted under 35 U.S.C. 154(b) by 0 days.

(21) Appl. No.: 15/866,609

(22) Filed: Jan. 10, 2018

(51) Int. Cl.
*B43K 23/012* (2006.01)
*B43K 23/008* (2006.01)
*B43K 7/02* (2006.01)

(52) U.S. Cl.
CPC ..... *B43K 23/012* (2013.01); *B43K 7/02* (2013.01); *B43K 23/008* (2013.01)

(58) Field of Classification Search
CPC ..... B43K 23/012; B43K 7/02; B43K 23/004; B43K 23/008; B43K 23/00
See application file for complete search history.

(56) References Cited

U.S. PATENT DOCUMENTS

| | | | | |
|---|---|---|---|---|
| 2,509,837 | A * | 5/1950 | Niizawa | B43K 7/00 294/25 |
| 3,733,139 | A * | 5/1973 | Neidhardt | B43K 27/08 401/17 |
| 3,947,132 | A * | 3/1976 | Fox | B43K 23/012 401/7 |
| D253,416 | S | 11/1979 | MacIntosh | |
| 4,738,556 | A | 4/1988 | Brown | |
| 4,986,682 | A | 1/1991 | Lu | |
| 5,314,260 | A | 5/1994 | Anderson | |
| 5,405,206 | A | 4/1995 | Bedol | |
| 5,529,415 | A | 6/1996 | Bishop | |
| 6,913,406 | B1 | 7/2005 | Nocerino | |
| 7,476,043 | B1 | 1/2009 | Rivas | |
| 9,333,796 | B2 | 5/2016 | Martin | |
| 2010/0143019 | A1 | 6/2010 | Merla, Jr. | |

* cited by examiner

*Primary Examiner* — David J Walczak

(57) ABSTRACT

A writing implement assembly for writing on a writing surface includes an ink dispenser is configured to be attached to a finger. The ink dispenser discharges ink when the ink dispenser engages a writing surface. A grip is removably attached to the ink dispenser to facilitate writing with the ink dispenser.

10 Claims, 6 Drawing Sheets

WRITING IMPLEMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to writing utensil devices and more particularly pertains to a new writing utensil device for writing on a writing surface.

BRIEF SUMMARY OF THE INVENTION

An embodiment of the disclosure meets the needs presented above by generally comprising an ink dispenser is configured to be attached to a finger. The ink dispenser discharges ink when the ink dispenser engages a writing surface. A grip is removably attached to the ink dispenser to facilitate writing with the ink dispenser.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
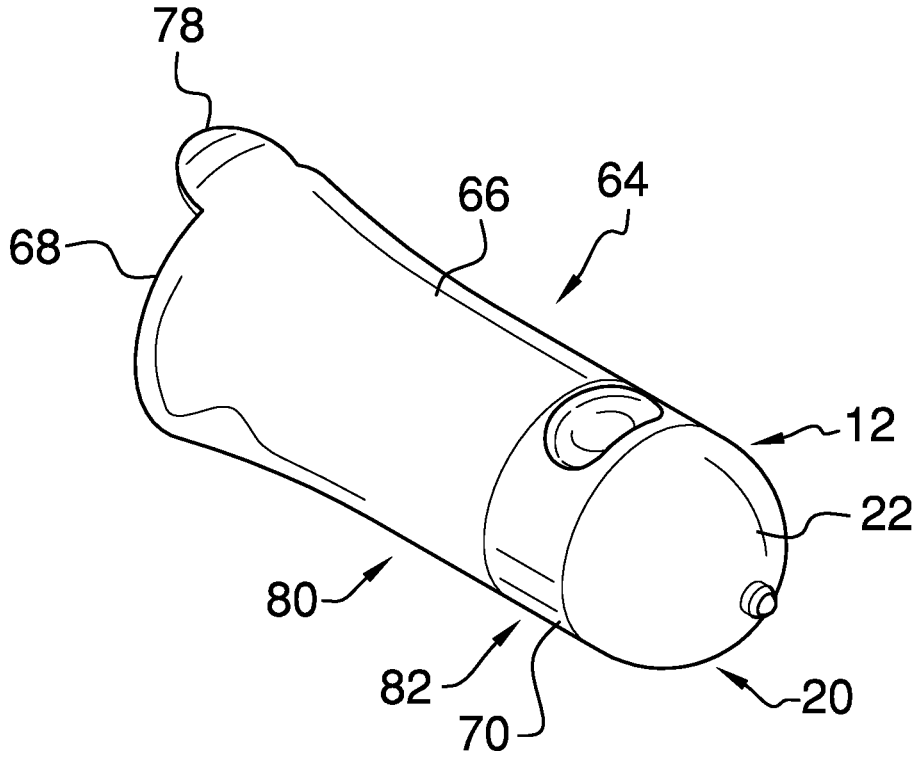
FIG. 1 is a top side view of a writing implement assembly according to an embodiment of the disclosure.
Figure 2:
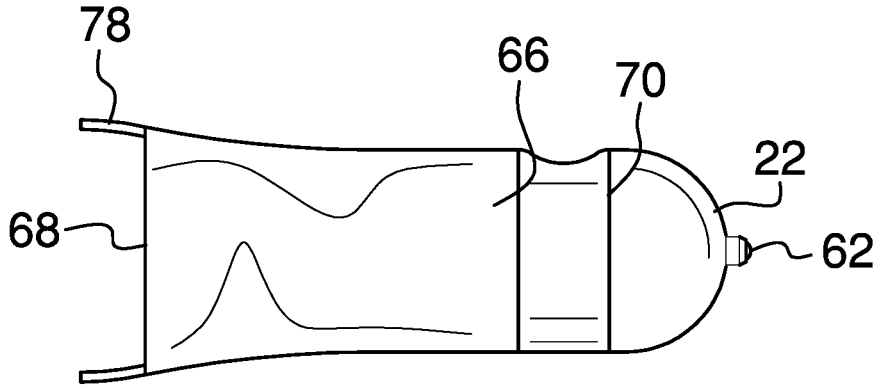
FIG. 2 is a bottom view of an embodiment of the disclosure.
Figure 3:
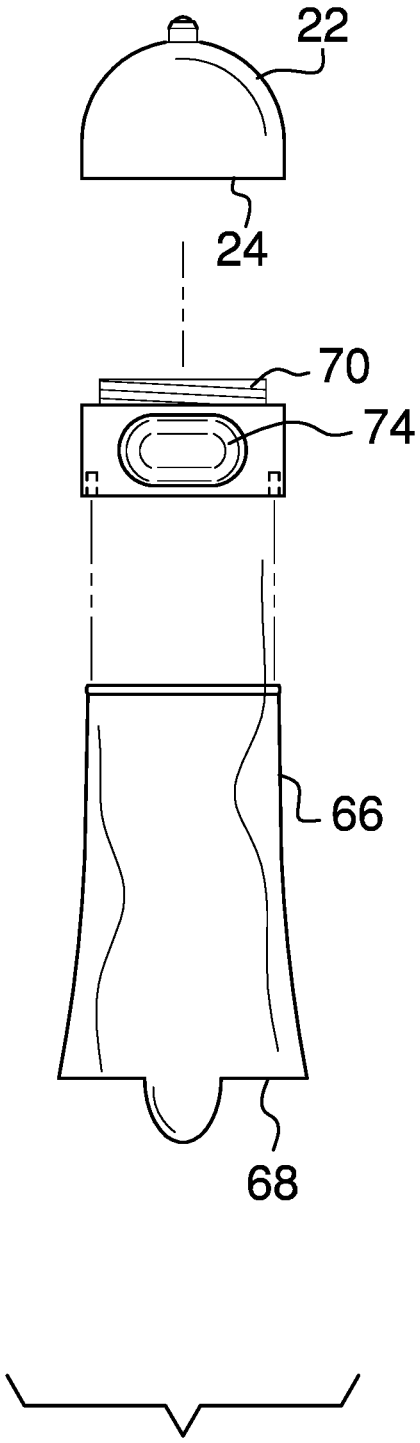
FIG. 3 is a front view of an embodiment of the disclosure.
Figure 4:
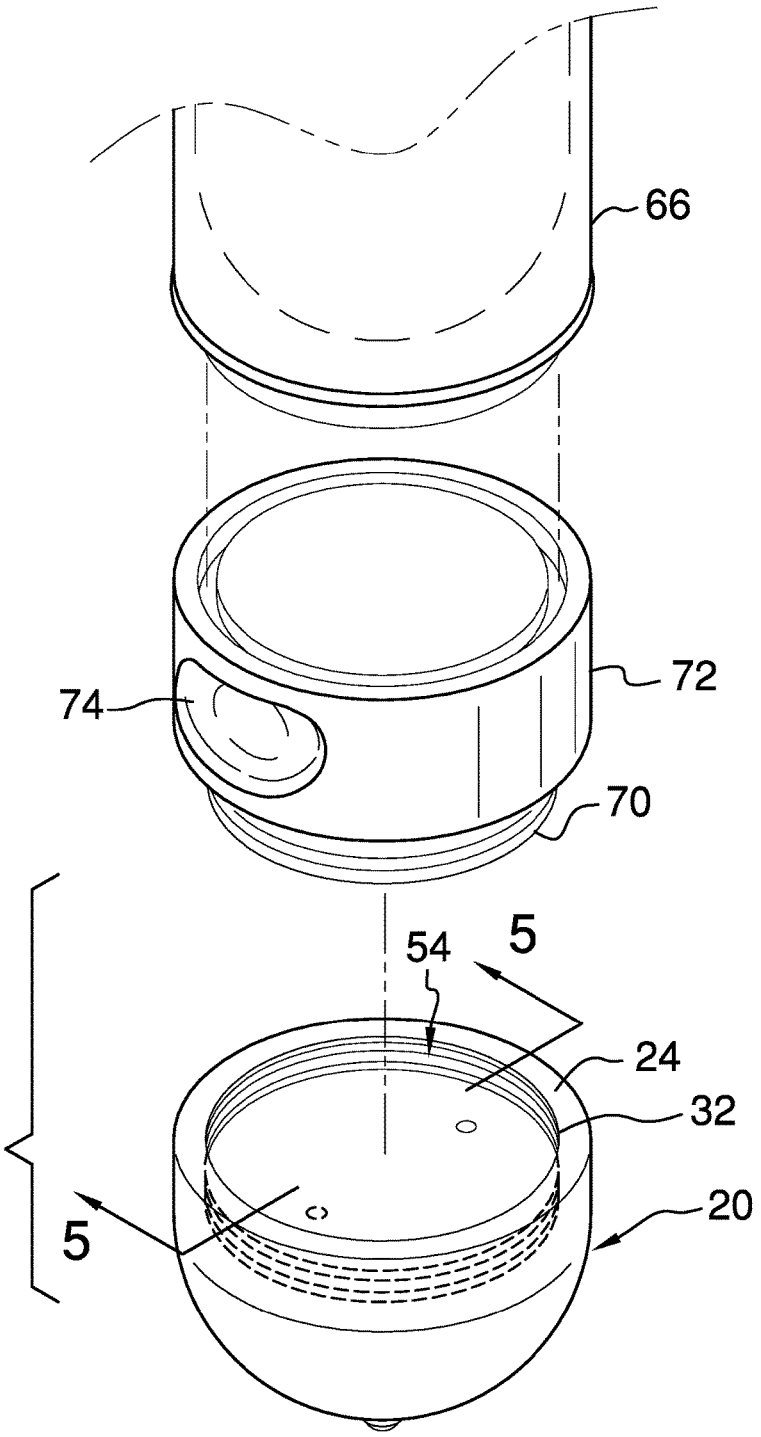
FIG. 4 is a front side view of an embodiment of the disclosure.
Figure 5:
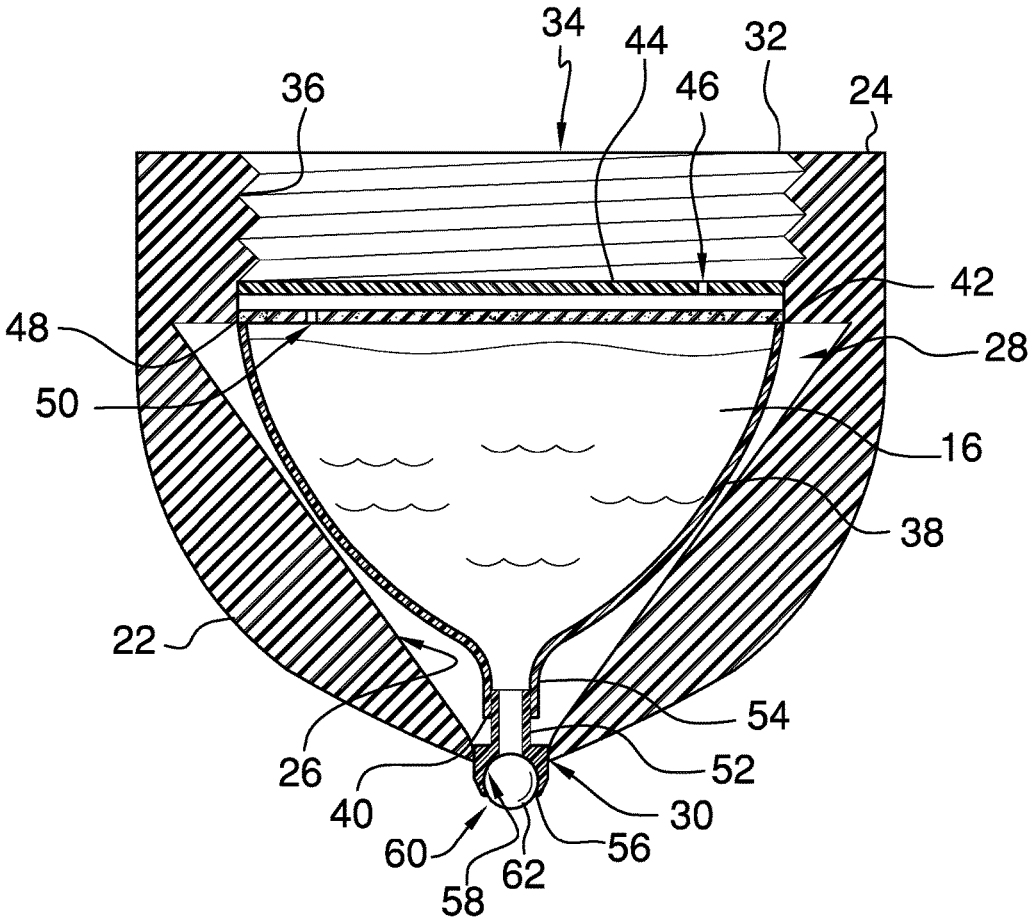
FIG. 5 is a cross-sectional view of an embodiment of the disclosure taken along line 5-5 of FIG. 4.
Figure 6:
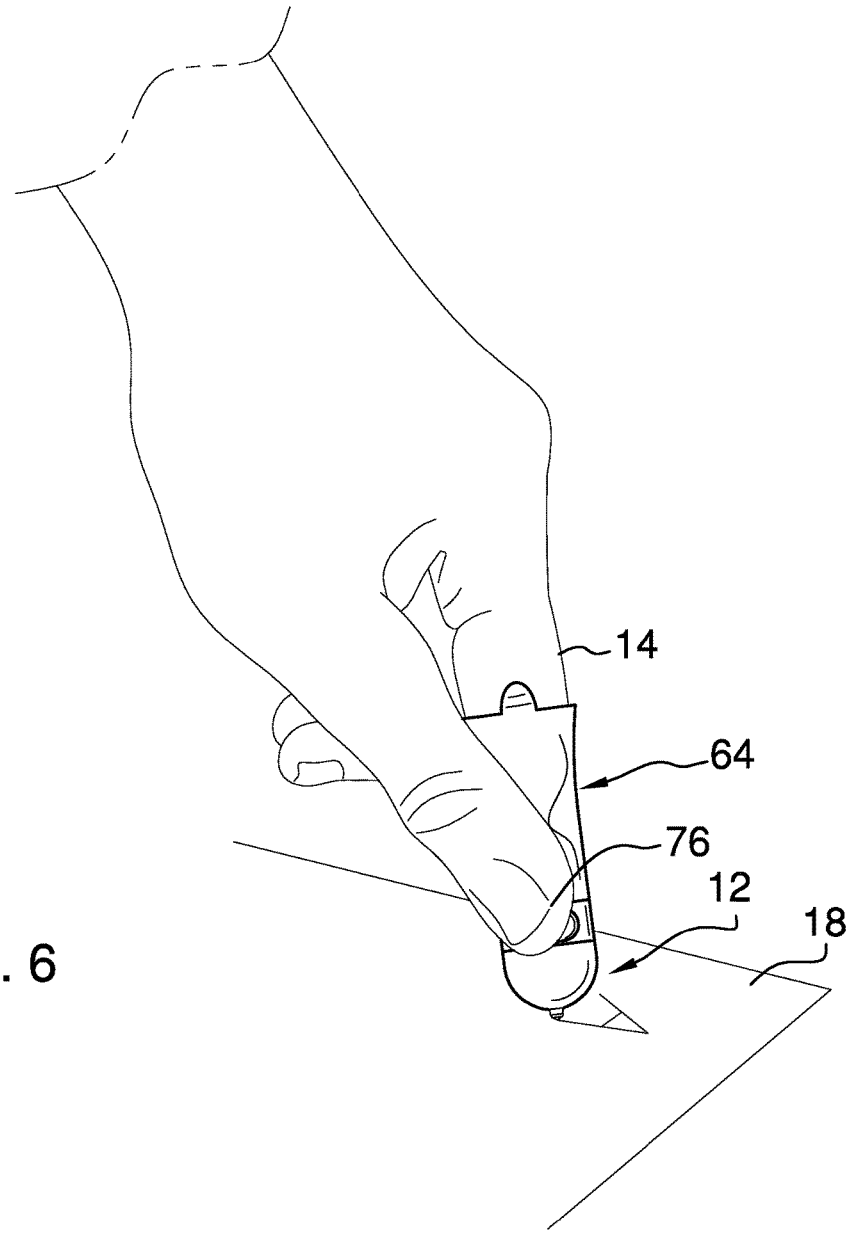
FIG. 6 is a front view of an embodiment of the disclosure.
Figure 7:
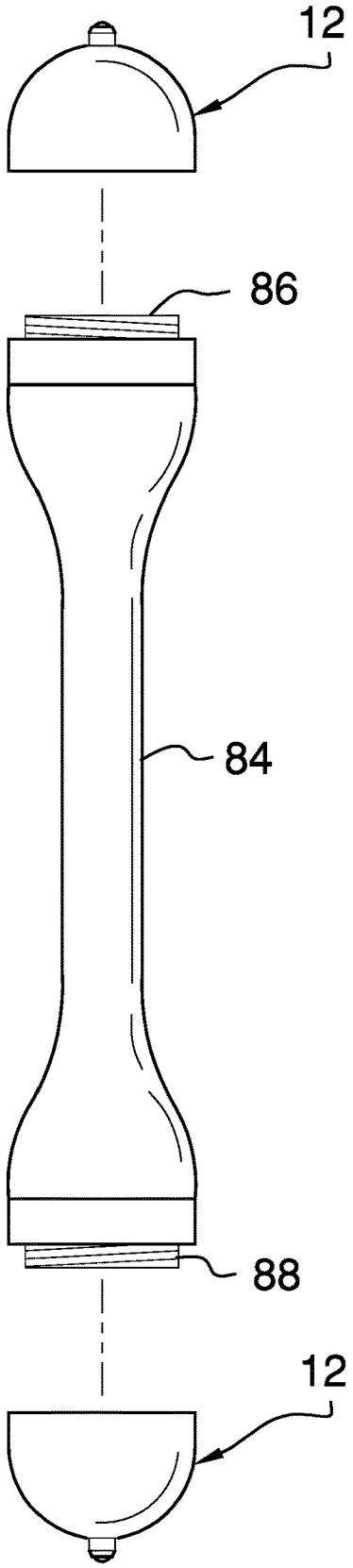
FIG. 7 is a side view of an embodiment of the disclosure.

With reference now to the drawings, and in particular to FIGS. 1 through 7 thereof, a new writing utensil device embodying the principles and concepts of an embodiment of the disclosure and generally designated by the reference numeral 10 will be described.

As best illustrated in FIGS. 1 through 7, the writing implement assembly 10 generally comprises an ink dispenser 12 that is attachable to a finger 14. The ink dispenser 12 discharges ink 16 when the ink dispenser 12 engages a writing surface 18. The ink dispenser 12 comprises a housing 20 that has an end wall 22 and a perimeter wall 24 that is attached to and extends away from the end wall 22. An interior 26 of the housing 20 defines a chamber 28. The end wall 22 has a discharging aperture 30 that extends into the chamber 28. The perimeter wall 24 has a terminal edge 32 that defines an opening 34 into the housing 20. The end wall 22 has a convexly arcuate shape and the perimeter wall 24 has an inner surface 36 that is threaded.

A funnel 38 is mounted within the housing 20. A quantity of fluidic ink 16 is positioned in the funnel 38. The funnel 38 has a discharge end 40 that is aligned with and fluidly coupled to the discharging aperture 30. A distal end 42 of the funnel relative 38 to the discharge end 40 faces the opening 34. The funnel 38 is comprised of a rigid material.

An interior wall 44 is positioned within the housing 20 and is located between the opening 34 and the funnel 38. The interior wall 44 has a vent 46 that extends therethrough and is comprised of a rigid material. A panel 48 is coupled to the distal end 42 of the funnel 38 with respect to the discharge end 40 and closes the distal end 42. The panel 48 has a vent 50 that extends therethrough. The vent 50 in the panel 48 is offset from the vent 46 in the interior wall 44. The panel 48 is comprised of resiliently bendable material.

A release tube 52 is fluidly coupled with the funnel 38. The release tube 52 has a first end 54 and a second end 56 and extends through the discharge aperture 30 such that the second end 56 is exposed. The release tube 52 has an interior surface 58 adjacent to the second end 56 that has a concave shape and defines a saddle 60. A roller 62 is rotatably positioned in the saddle 60 and extends outwardly from the second end 56. The roller 62 releases ink 16 from the funnel 38 outwardly through the second end 56 of the release tube 52.

A grip 64 is removably attached to the ink dispenser 12 to facilitate writing with the ink dispenser 12. The grip 64 comprises a sleeve 66 that is worn on a person's finger 14. The sleeve 66 is removably attached to the ink dispenser 12. The sleeve 66 has a finger receiving end 68 and a coupler end 70. The finger receiving end 68 is open and the coupler end 70 is removably attached to the ink dispenser 12. The coupler end 70 includes a male threaded member extendable in and threadably coupled to the housing 20. The sleeve 66 comprises a resiliently stretchable material. The sleeve 66 has an outer surface 72 that has indent 74 therein positioned adjacent to the coupler. The indent 74 receives a thumb 76. A tab 78 is attached to and extends outwardly from the finger receiving end 68 of the sleeve 66. The tab 78 facilitates pulling of the sleeve 66 onto the finger 14. The sleeve 66 may comprise a finger section 80 and a thumb section 82 wherein the finger section 80 receives the finger 14 and the thumb section 82 has the indent 74 positioned on the outer surface 72 thereof.

In an alternative embodiment, the grip 64 comprises an elongated shaft 84 that has a first coupling end 86 and a second coupling end 88. Each of the first and second coupling ends 86, 88 is removably coupled to the ink dispenser 12. Each of the first and second coupling ends 86, 88 comprises a male threaded member. The elongated shaft may have a tubular shape and a length greater than 3.0 inches.

In use, the sleeve 66 is threadably attached to the ink dispenser 12. The person's finger 14 is then inserted into the sleeve 66. The person's thumb 76 is placed on the indent 74. The finger 14 and the thumb 76 are used to direct the roller 62 and engage the roller 62 along the writing surface 18 to write thereon.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A writing utensil assembly comprising:

an ink dispenser discharging ink when said ink dispenser engages a writing surface, said ink dispenser comprising a housing having an end wall and a perimeter wall being attached to and extending away from said end wall, an interior of said housing defining a chamber, said end wall has a discharging aperture extending into said chamber, said perimeter wall having a terminal edge defining an opening into said housing, said end wall having a convexly arcuate shape, said perimeter wall having an inner surface being threaded, said ink dispenser further includes a funnel being mounted within said housing, said ink being positioned in said funnel, said funnel has a discharge end being aligned with and fluidly coupled to said discharging aperture, a distal end of said funnel with respect to said discharge end facing said opening, said funnel being comprised of a rigid material, said ink dispenser further including an interior wall being positioned within said housing and being located between said opening and said funnel, said interior wall having a vent extending therethrough, said interior wall being comprised of a rigid material; and a grip being removably attached to said ink dispenser to facilitate writing with said ink dispenser.

2. The writing utensil assembly according to claim 1, wherein said ink dispenser further includes a panel being coupled to said distal end of said funnel with respect to said discharge end and closing said distal end, said panel having a vent extending therethrough, said vent in said panel being offset from said vent in said interior wall, said panel being comprised of resiliently bendable material.

3. The writing utensil assembly according to claim 2, wherein said ink dispenser further includes a release tube being fluidly coupled with said funnel, said release tube having a first end and a second end, said release tube extending through said discharge aperture such that said second end is exposed, said release tube having an interior surface adjacent to said second end having a concave shape and defining a saddle.

4. The writing utensil assembly according to claim 3, wherein said ink dispenser further includes a roller being rotatably positioned in said saddle, said roller extending outwardly from said second end, said roller releasing said ink from said funnel outwardly through said second end of said release tube.

5. The writing utensil assembly according to claim 1, wherein said grip comprises a sleeve configured to be worn on a person's finger, said sleeve being removably attached to said ink dispenser.

6. The writing utensil assembly according to claim 5, wherein said sleeve has a finger receiving end and a coupler end, said finger receiving end being open, said coupler end being removably attached to said ink dispenser, said coupler end including a male threaded member extendable in and threadably coupled to a housing of said ink dispenser, said sleeve comprising a resiliently stretchable material, said sleeve having an outer surface having indent therein positioned adjacent to said coupler, said indent being configured to receive a thumb.

7. The writing utensil assembly according to claim 6, wherein said grip comprises a tab being attached to and extending outwardly from said finger receiving end of said sleeve, said tab facilitating pulling of said sleeve onto the finger.

8. The writing utensil assembly according to claim 1, wherein said grip comprises an elongated shaft having a first coupling end and a second coupling end, each of said first and second coupling ends being removably and alternatively couplable to said ink dispenser, each of said first and second coupling ends comprising a male threaded member.

9. The writing utensil assembly according to claim 8, wherein said elongated shaft having a tubular shape and having a length greater than 3.0 inches.

10. A writing utensil assembly comprising:

an ink dispenser discharging ink when said ink dispenser engages a writing surface, said ink dispenser comprising:

a housing having an end wall and a perimeter wall being attached to and extending away from said end wall, an interior of said housing defining a chamber, said end wall having a discharging aperture extending into said chamber, said perimeter wall having a terminal edge defining an opening into said housing, said end wall having a convexly arcuate shape, said perimeter wall having an inner surface being threaded;

a funnel being mounted within said housing, said ink being positioned in said funnel, said funnel having a discharge end being aligned with and fluidly coupled to said discharging aperture, a distal end of said funnel with respect to said discharge end facing said opening, said funnel being comprised of a rigid material;

an interior wall being positioned within said housing and being located between said opening and said funnel, said interior wall having a vent extending therethrough, said interior wall being comprised of a rigid material;

a panel being coupled to said distal end of said funnel with respect to said discharge end and closing said distal end, said panel having a vent extending therethrough, said vent in said panel being offset from said vent in said interior wall, said panel being comprised of resiliently bendable material;

a release tube being fluidly coupled with said funnel, said release tube having a first end and a second end, said release tube extending through said discharge aperture such that said second end is exposed, said release tube having an interior surface adjacent to said second end having a concave shape and defining a saddle;

a roller being rotatably positioned in said saddle, said roller extending outwardly from said second end, said roller releasing said ink from said funnel outwardly through said second end of said release tube;

a grip being removably attached to said ink dispenser to facilitate writing with said ink dispenser, said grip comprising:

a sleeve configured to be worn on a person's finger, said sleeve being removably attached to said ink dispenser, said sleeve having a finger receiving end and a coupler end, said finger receiving end being open, said coupler end being removably attached to said ink dispenser, said coupler end including a male threaded member extendable in and threadably coupled to said housing, said sleeve comprising a resiliently stretchable material, said sleeve having an outer surface having indent therein positioned adjacent to said coupler, said indent being configured to receive a thumb; and a tab being attached to and extending outwardly from said finger receiving end of said sleeve, said tab facilitating pulling of said sleeve onto the finger.

* * * * *